US008919044B2

(12) United States Patent
Baumert

(10) Patent No.: US 8,919,044 B2
(45) Date of Patent: Dec. 30, 2014

(54) SILL AND OPENING-LEAF ASSEMBLY FOR A DOOR THAT ESSENTIALLY IS FLUID-TIGHT TO A LIQUID OR GASEOUS FLUID AND IS INTENDED TO SEAL AN OPENING SEPARATING TWO SPACES IN A BUILDING OR MONUMENT

(75) Inventor: Bernard Baumert, Schaeffersheim (FR)

(73) Assignee: Baumert, Schaeffersheim (FR)

( * ) Notice: Subject to any disclaimer, the term of this patent is extended or adjusted under 35 U.S.C. 154(b) by 37 days.

(21) Appl. No.: 13/825,151

(22) PCT Filed: Sep. 20, 2010

(86) PCT No.: PCT/FR2010/051955

§ 371 (c)(1),
(2), (4) Date: Jun. 17, 2013

(87) PCT Pub. No.: WO2012/038608

PCT Pub. Date: Mar. 29, 2012

(65) Prior Publication Data

US 2014/0173992 A1 Jun. 26, 2014

(51) Int. Cl.

| | |
|---|---|
| ***E06B 1/70*** | (2006.01) |
| ***E06B 7/18*** | (2006.01) |
| ***E06B 5/14*** | (2006.01) |
| ***E06B 7/23*** | (2006.01) |

(52) U.S. Cl.

CPC ... *E06B 7/18* (2013.01); *E06B 1/70* (2013.01); *E06B 5/14* (2013.01); *E06B 7/2316* (2013.01)

USPC ..... 49/470; 49/469; 52/211

(58) Field of Classification Search

USPC ..... 49/467, 469, 470, 471, 495.1; 52/211 X, 52/204.5, 209

See application file for complete search history.

(56) References Cited

U.S. PATENT DOCUMENTS

| | | | | |
|---|---|---|---|---|
| 2,055,512 | A * | 9/1936 | Wallace | 251/364 |
| 2,568,477 | A * | 9/1951 | Westlund | 292/288 |
| 2,579,875 | A * | 12/1951 | Stanko | 49/469 |
| 5,150,544 | A * | 9/1992 | Burnett | 49/493.1 |

(Continued)

FOREIGN PATENT DOCUMENTS

| | | |
|---|---|---|
| DE | 198 41 180 A1 | 3/2000 |
| GB | 2 333 797 A | 8/1999 |

OTHER PUBLICATIONS

International Search Report issued in corresponding application No. PCT/FR2010/051955 mailed Mar. 21, 2011.

*Primary Examiner* — Jerry Redman

(74) *Attorney, Agent, or Firm* — Carter, DeLuca, Farrell & Schmidt, LLP

(57) ABSTRACT

The subject of the present disclosure is a sill and opening leaf assembly for a door that is fluid-tight to a liquid or gaseous fluid and intended to seal an opening separating two spaces in a building, wherein one of the edge faces or lower edge face of the opening leaf is situated, when mounted, facing a floor surface, and a sill able to provide fluid-tightness, of the bottom part of the door concerned between the lower edge face and the floor surface. The sill includes at least one flat and elongate gasket element, of the tongue type, fixed via one of its longitudinal sides to the lower edge face and a sealing and travel groove made in the floor surface across the opening concerned and intended to house the gasket element able to collaborate in travel with one of the longitudinal edges of the groove.

17 Claims, 6 Drawing Sheets

(56) References Cited

U.S. PATENT DOCUMENTS 5,174,065 A * 12/1992 Schlicht ..... 49/489.1
5,214,880 A * 6/1993 Woodruff et al. ..... 49/490.1
5,706,607 A * 1/1998 Frey ..... 49/478.1
6,061,967 A * 5/2000 Judds ..... 49/469
7,644,539 B2 * 1/2010 Baxter ..... 49/303
2010/0064590 A1 * 3/2010 Jones et al. ..... 49/469

* cited by examiner

SILL AND OPENING-LEAF ASSEMBLY FOR A DOOR THAT ESSENTIALLY IS FLUID-TIGHT TO A LIQUID OR GASEOUS FLUID AND IS INTENDED TO SEAL AN OPENING SEPARATING TWO SPACES IN A BUILDING OR MONUMENT

BACKGROUND

The present invention relates to the field of doors for openings in buildings or monuments, specifically high-security buildings or monuments, such as nuclear power plants, and also relates to a sill and opening-leaf assembly for a door that is essentially fluid-tight to a liquid or gaseous fluid and is intended to seal an opening separating two spaces in a building or monument.

It is known that the sill is the element that is situated across and at the bottom of the opening of a door separating two spaces of a building or monument, and functions primarily to ensure that the bottom part of the door, in the closed state, i.e., the empty space between the lower edge face of the of the opening leaf of the door and the floor or ground surface, is protected from infiltrations of air, water or dust.

However, a sill usually has a step-like appearance forming an obstacle in the lower part of the door opening, which poses a problem in terms of a height to be cleared, in particular for the wheels or casters of the wheelchairs of persons with reduced mobility, or those of carts or other rolling objects supporting materials or products that are particularly sensitive, especially in the filed of high security, such as in the nuclear industry, which requires flat or nearly flat rolling surfaces without any obstacles to clear.

A known solution to this problem consists in installing transportable sill-clearing ramps which adapt to various heights of sills and which are placed thereon.

However, although these ramps enable the obstacle effect produced by current sills to be reduced considerably, the structure thereof comprises two clearing slopes which necessarily require an inclination of the rolling cart, which can be detrimental to the material or products transported by same. In addition, considering the security conditions required in certain types of high-security buildings, these transportable ramps cannot always be stored close to the door or on a mobile cart. On the other hand, they need to be installed and removed upon each opening and closing of the door, which is restrictive to the person crossing over same.

The aim of the present invention is to overcome these disadvantages by proposing a door sill and opening-leaf assembly that is fluid-tight to a liquid or gaseous fluid, which is permanently installed and does not create any obstacle or clearing slope in the lower part of the door opening, in particular as concerns the wheels or casters of a cart or other rolling object, while at the same time providing an effective fluid-tightness of the bottom part of the door concerned, with respect to gaseous or liquid fluids.

BRIEF SUMMARY

For this purpose, the present invention relates to a sill and opening-leaf assembly for a door that is essentially fluid-tight to a liquid or gaseous fluid and is intended to seal an opening separating two spaces of a building or monument, comprising an opening leaf, of which one of the edge faces or lower edge face is situated, when mounted, facing a floor surface, and a sill able to provide fluid-tightness, with respect to said fluid, of the bottom part of the door concerned, between the lower edge face and said floor surface, characterized essentially in that said sill firstly includes at least one flat and elongate gasket element of the tongue type, which comprises a front longitudinal surface and a rear longitudinal surface, and which is attached via one of its longitudinal sides or longitudinal attachment side to said lower edge face and, secondly, comprises at least one sealing and travel groove, comprising a bottom and two longitudinal edges, which is made in said floor surface across the opening concerned, and in that said gasket element, when mounted, is able to engage with either of said longitudinal edges, by being allowed to travel into said groove, depending on whether a pressure force is exerted by a liquid or gaseous fluid from one of said spaces on the front longitudinal surface or rear longitudinal surface of said gasket element, so as to ensure the fluid-tightness of the bottom part of said door concerned.

The invention will be better understood by means of the following description, which relates to a preferred embodiment given for non-limiting illustrative purposes, and which is explained with reference to the appended schematic drawings, in which:

DETAILED DESCRIPTION

Figure 1:
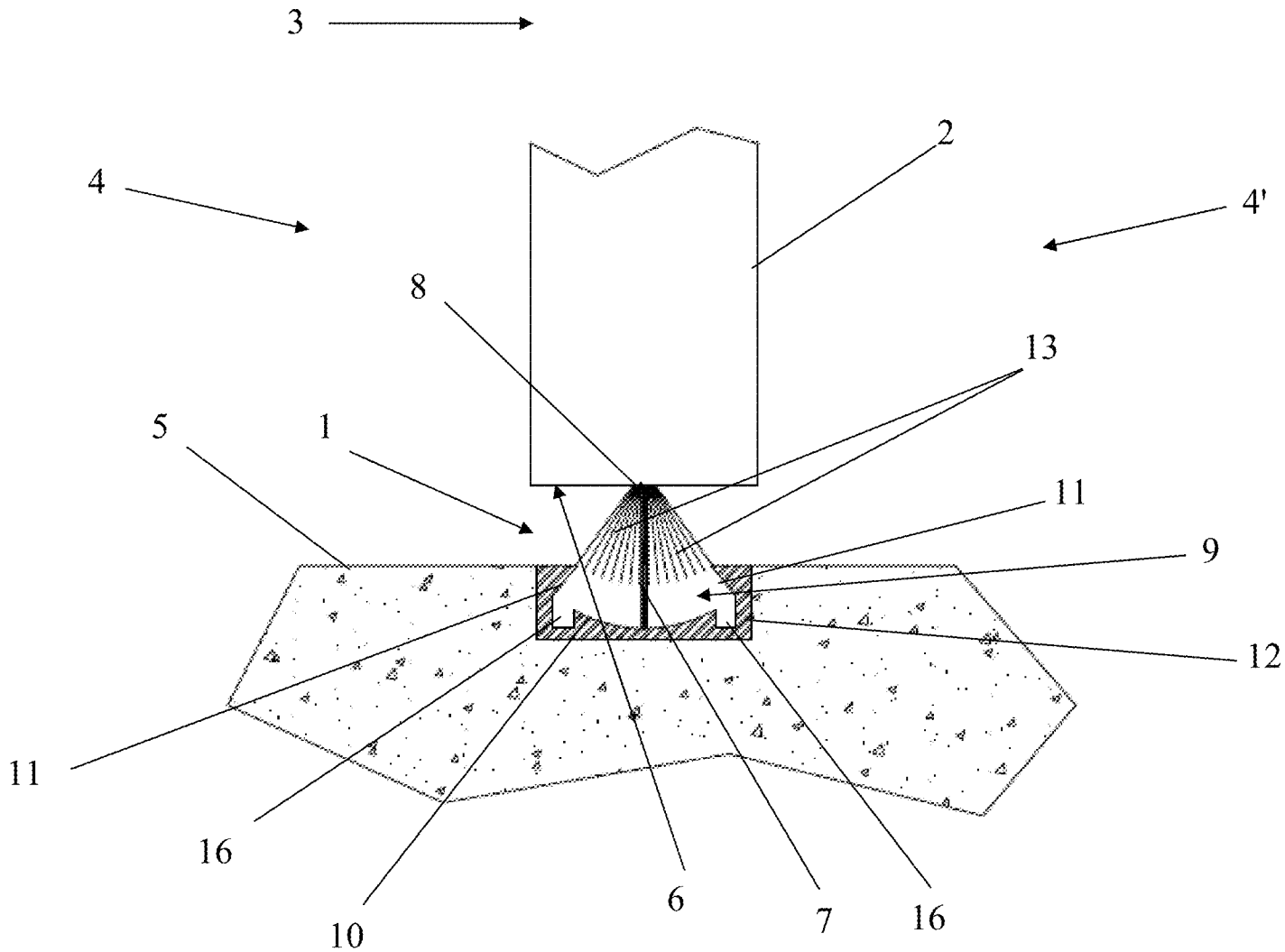
FIG. 1 shows a cross-sectional view of a sill and opening-leaf assembly according to the present invention, with a flexible gasket element and a dust-guard brush, when said element is in the idle state, which lies in a vertical mid-plane at the bottom of the groove.

The figures show a sill 1 and opening leaf 2 assembly for a door that is essentially fluid-tight to a liquid or gaseous fluid and intended to seal an opening 3 separating two spaces 4, 4' of a building or monument, including an opening leaf 2 of which one of the edge faces or lower edge face 6 is situated, when mounted, facing a floor surface 5, and a sill 1 able to provide fluid-tightness, with respect to said fluid, of the bottom part of the door concerned, i.e., the empty space situated between the lower edge face 6 and said floor surface 5.

According to the present invention, such a sill 1 firstly comprises at least one flat and elongate gasket element 7 of the tongue type, which comprises a front longitudinal surface and a rear longitudinal surface, and which is attached via one of its longitudinal sides or longitudinal attachment side 8 to said lower edge face 6 and, secondly, comprises at a sealing and travel groove 9, comprising a bottom 10 and two longitudinal edges 11, which is made in said floor surface 5 across the opening 3 concerned and intended to receive the gasket element 7.

Still in accordance with the present invention, the gasket element 7, when mounted, is able to engage with either of said longitudinal edges 11, by being allowed to travel into said groove 9, depending on whether a pressure force is exerted by a liquid or gaseous fluid from one of said spaces 4 or 4' on the front longitudinal surface or rear longitudinal surface of said gasket element 7, so as to ensure the fluid-tightness of the bottom part of said door concerned, between said lower edge face 6 and said floor surface 5.

In a first embodiment of the travel of the gasket element 7 in the groove 9, the gasket element 7 can be flexible or soft, at least on the longitudinal side 8 thereof, which is attached to the lower edge face 6 of the opening leaf 2, so as to allow it [said gasket element] a freedom of movement, by elastically deforming and bending around said longitudinal attachment side 8, in the groove 9, between the two longitudinal edges 11 thereof (FIGS. 1 to 5).

It will be understood that, in this first embodiment, the gasket element 7 can be flexible or soft on the longitudinal side 8 thereof or over all or part of the width thereof, including said longitudinal side 8.

Figure 6:
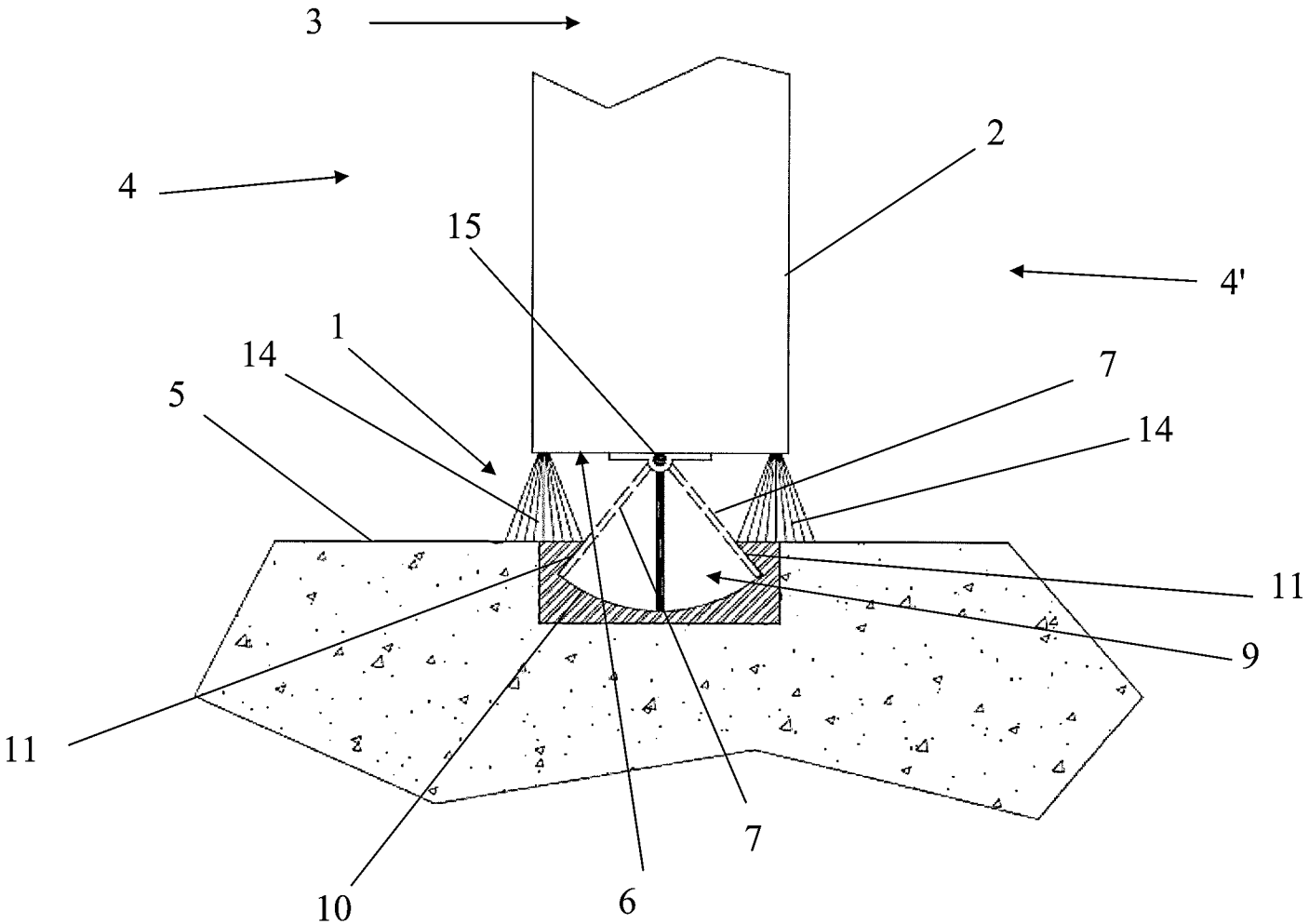
FIG. 6 shows a cross-sectional view of a sill and opening-leaf assembly according to the present invention, with a hinged gasket element and two dust-guard brushes, which, by means of dashed lines, shows two travel limit positions of the gasket element inside the groove, starting from the vertical idle position thereof.

In a second embodiment of the travel of the gasket element 7 inside the groove 9, the gasket element 7 can be rigid, semi-rigid or flexible, and pivotably mounted via the longitudinal attachment side 8 thereof, by means of a hinge-type pin joint, about a swivel pin 15 extending along the lower edge face 6, so as to allow the gasket element 7 a freedom of travel, by rotating about said swivel pin 15, inside the groove 9 between the longitudinal edges 11 thereof (FIG. 6).

Figure 2:
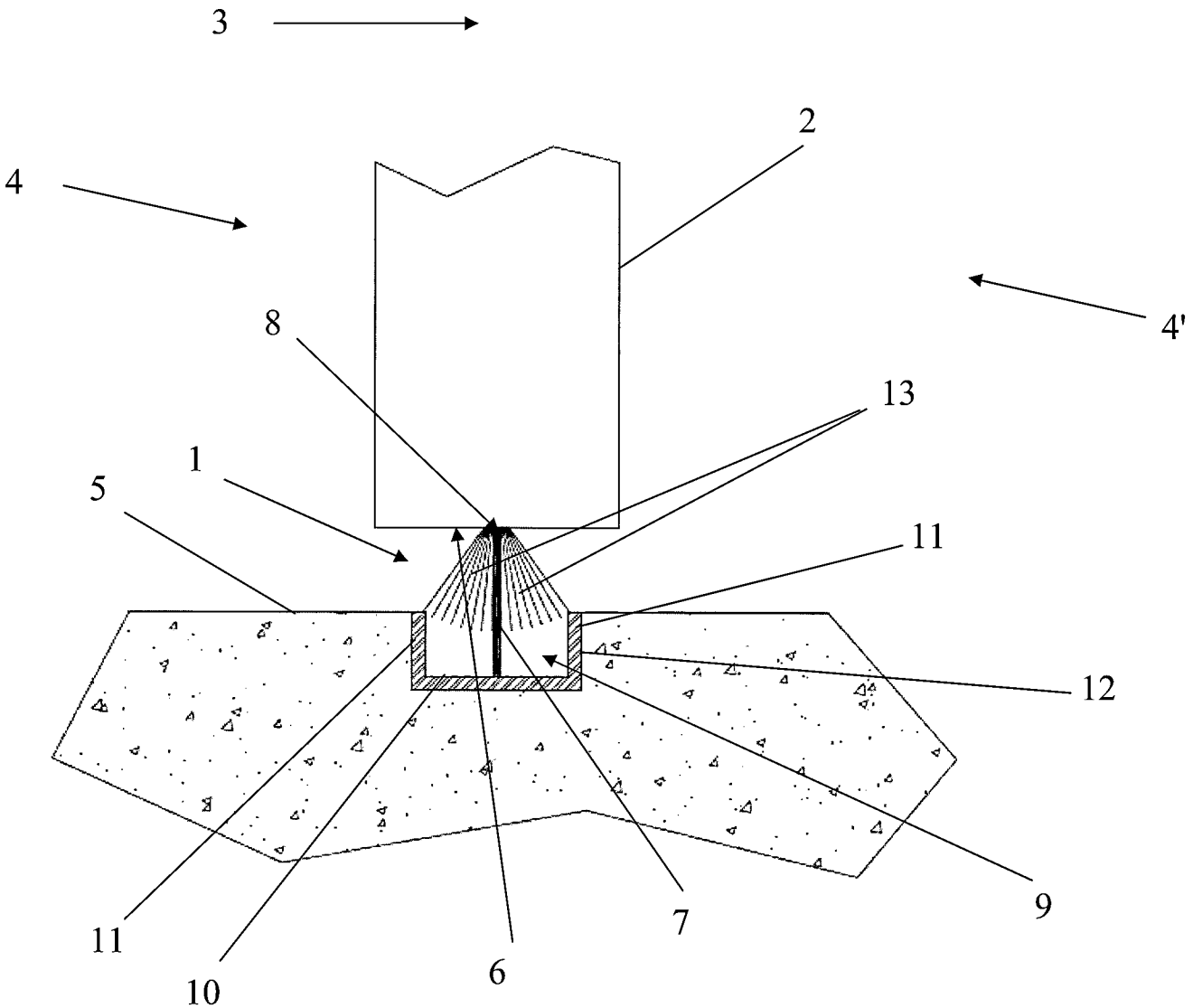
FIG. 2 shows the sill and opening-leaf assembly of FIG. 1, in a first alternative embodiment of the groove.
Figure 3:
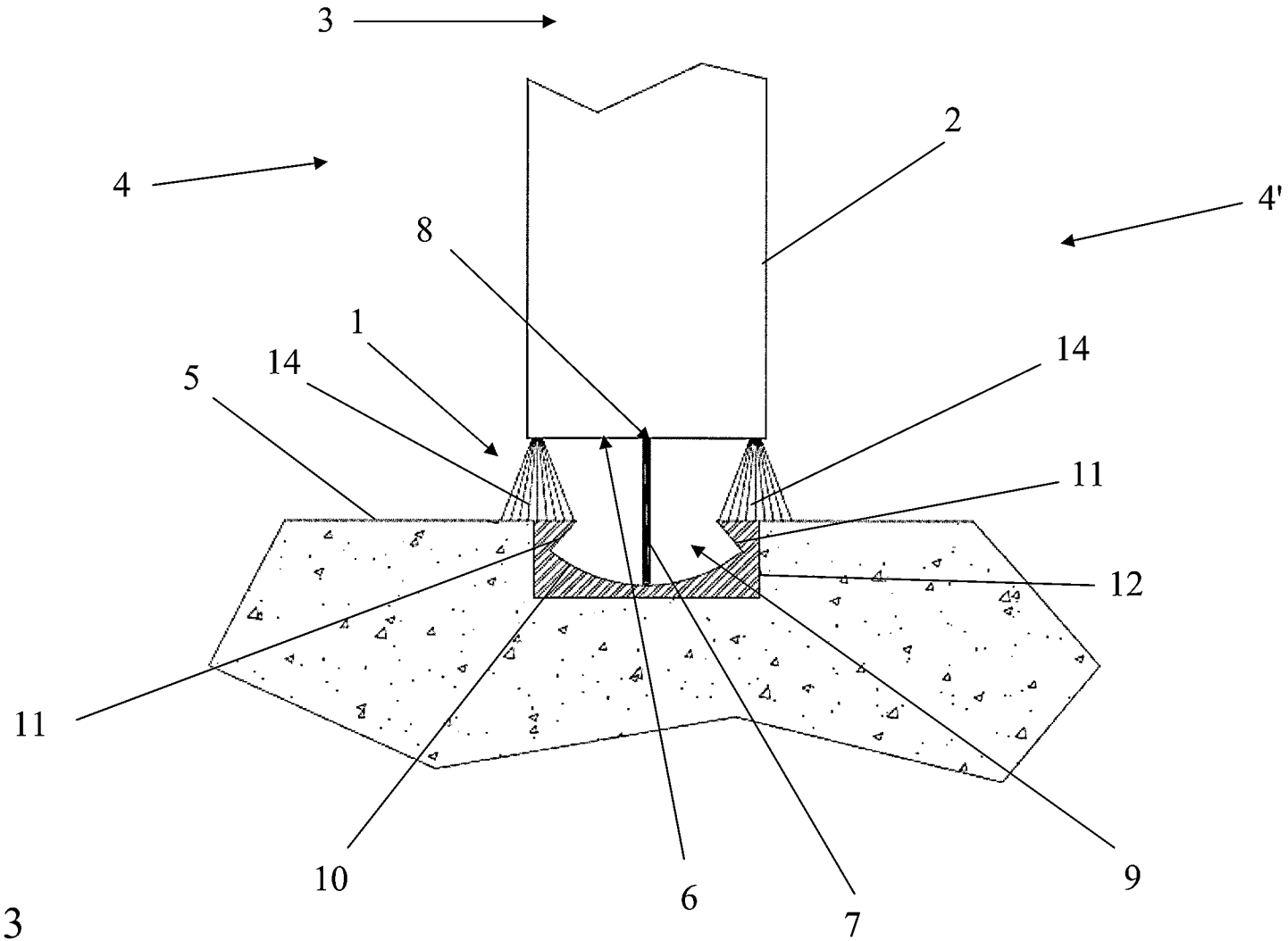
FIG. 3 shows the sill and opening-leaf assembly of FIG. 1, in a second alternative embodiment of the groove, with two dust-guard brushes.
Figure 4:
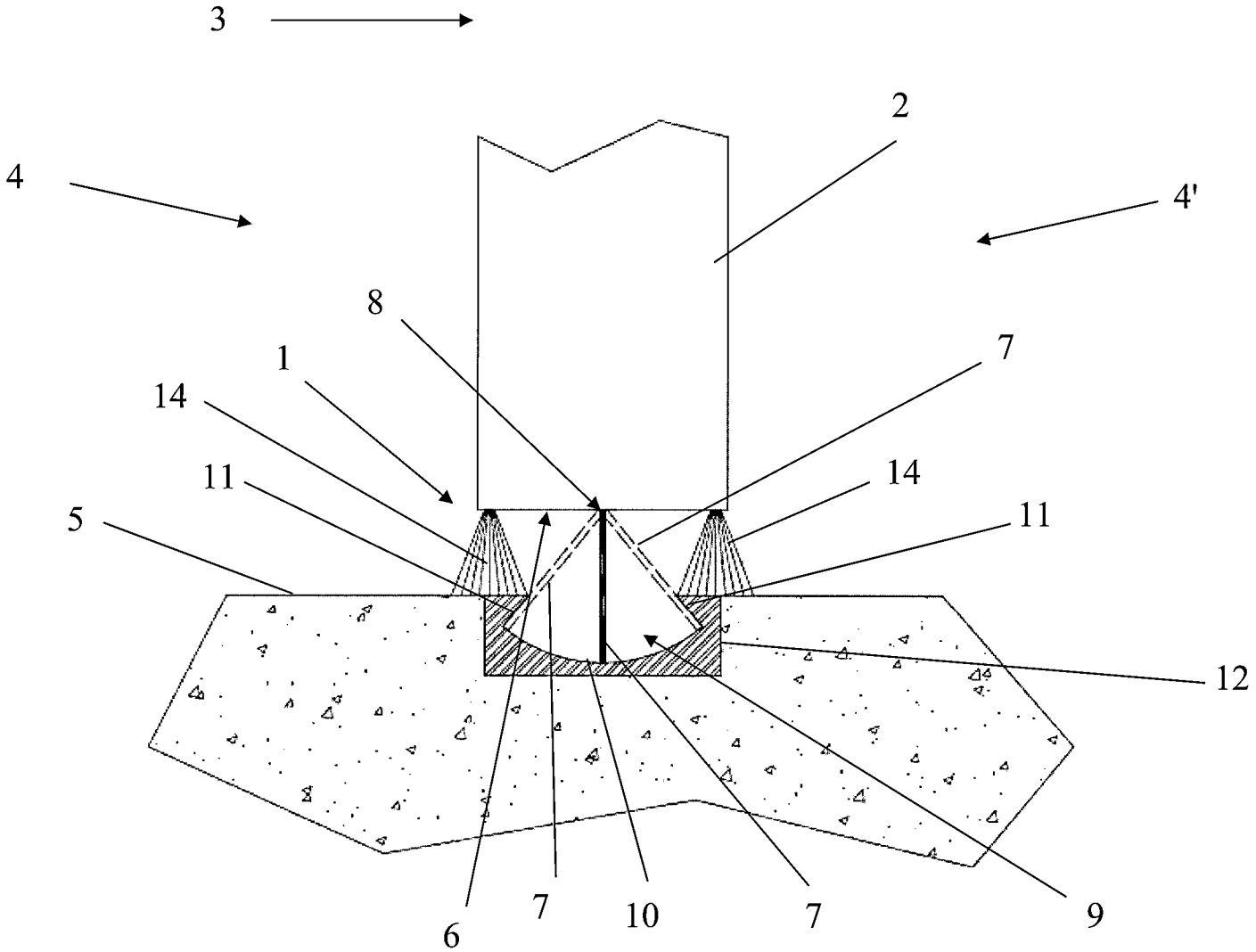
FIG. 4 shows the sill and opening-leaf assembly of FIG. 3, which, by means of dashed lines, shows two travel limit positions of the gasket element inside the groove.
Figure 5:
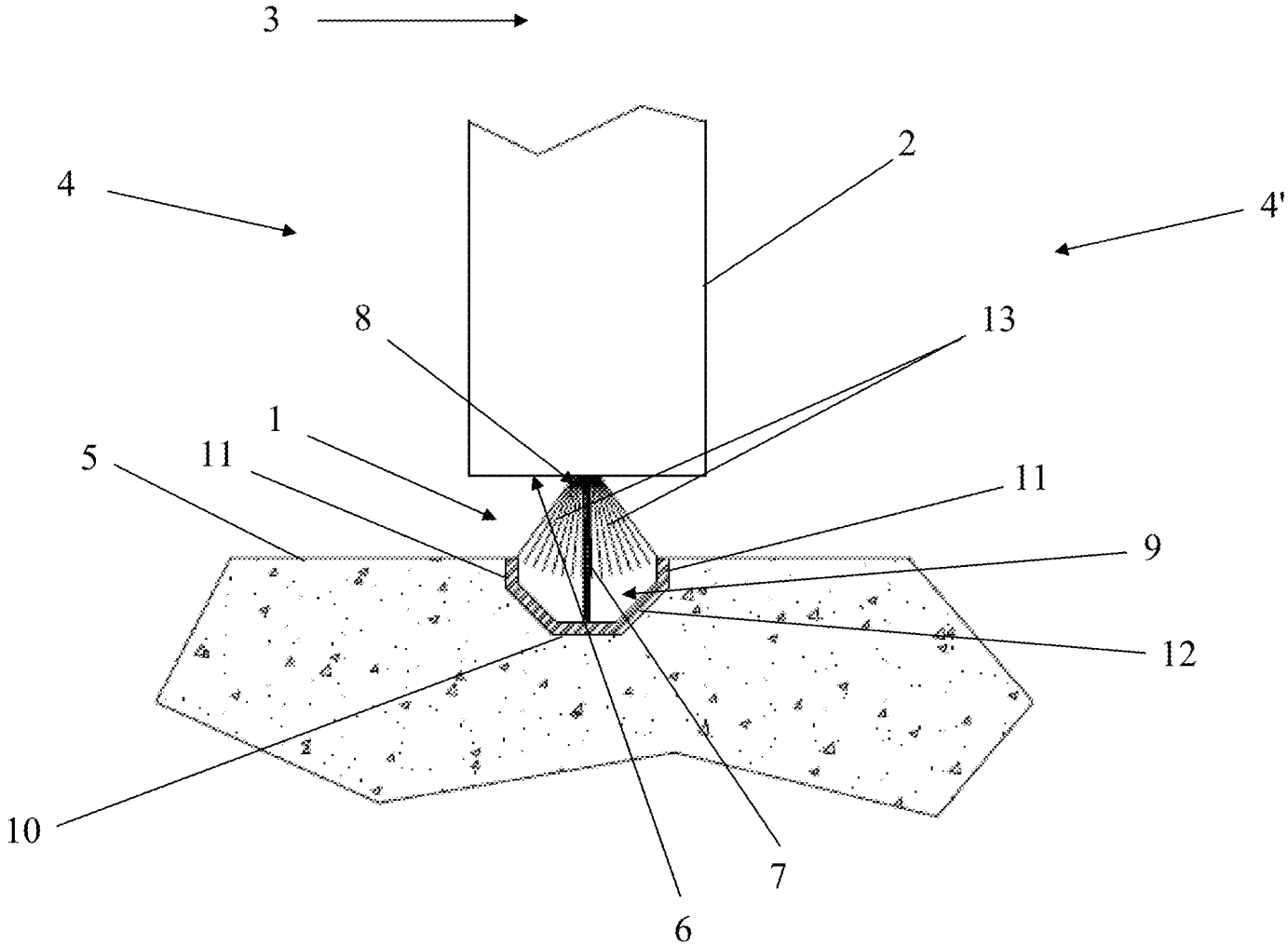
FIG. 5 shows the sill and opening-leaf assembly of FIG. 1, in a third alternative embodiment of the groove.

The longitudinal edges 11 of the groove 9 can preferably each form a right angle with the floor surface 5 (FIGS. 2 and 5). Alternatively, they can likewise each be inclined toward the bottom 10 of the groove 9 (FIGS. 1, 3, 4 and 6). This is done so that each longitudinal edge 11 forms a longitudinal abutment enabling the gasket 7 to be retained inside the groove 9 when a pressure force is exerted by the liquid or gaseous fluid on the front longitudinal surface or rear longitudinal surface of said gasket element (FIGS. 4 to 6).

Still preferably so, in the case of inclined longitudinal edges 11, same can be inclined such that the internal surfaces thereof are each situated in a plan passing substantially through the longitudinal attachment side 8 of the gasket element 7 and, where appropriate, preferably through the swivel pin 15. This is done to enable the gasket 7 and the corresponding inclined longitudinal edge 7 to be pressed together perfectly or nearly perfectly, with a view to producing the most effective fluid-tightness possible. Of course, in the case where the longitudinal edges 11 are not inclined in said plane, a gasket element 7 in flexible or soft form, due to the particular flexibility thereof and to the pushing force of the liquid or gaseous fluid being exerted on one of the front or rear faces thereof, is pressed against one of said edges.

It will be understood that, when the door is opened, the movement of the opening leaf 2 will result in the gasket element 7 exiting and being released from the groove 9, which gasket element 7 will be inserted therein when the door is closed, due to elasticity thereof and to the freely hinged movement of same about the pin attached to the lower edge face 6 therealong.

Still preferably so, such a groove 9 can have an overall U-shaped cross-section (FIGS. 2 and 5) or dovetail-shaped cross-section (FIGS. 1, 3, 4 and 6), preferably with a flat bottom (FIGS. 2 and 5) or an arc of circle-shaped bottom (FIGS. 1, 3, 4 and 6). In addition, the groove 9 can be made in an insert 12 embedded in the floor surface 5 (figures).

Furthermore, the present invention can advantageously further provide for a protective dust-guard system 13 or 14 extending longitudinally on either side of the gasket element 7, so as to prevent the dust from either of the two spaces 4 or 4' separated by the door opening 3, respectively, from reaching the groove 9 and, in particular, from accumulating therein.

In a preferred embodiment of the protective dust-guard system, same can consist of an elongate dust-guard brush 13 that can be attached to the lower edge face 6 of the opening leave 2, where the gasket element 7 is attached, and which can comprise two dust-guard brush portions 13 extending on either side of the gasket element 7, as far as the corresponding floor surface 5, and each forming a protective guard against the dust from one of the two spaces 4 or 4', respectively (FIGS. 1, 2 and 5).

In another embodiment of the protective dust-guard system, same can consist of two dust-guard brushes 14 each attached to the lower edge face 6 of the opening leaf 2, on either side of and separately from the gasket element 7, said dust-guard brushes 14 each extending as far as the corresponding floor surface 5 (FIGS. 3, 4 and 6), so that each forms a protective guard against the dust from one of the two spaces 4 or 4', respectively.

The or each dust-guard brush 13 or 14 can be made from natural, synthetic or metal bristles, which, at one of the ends thereof, are pressed into a support strip attached to or built into the lower edge face 6.

On the other hand, the present invention can advantageously provide for the bottom 10 of the groove 9 to comprise at least one cavity 16 for receiving dust, preferably two receiving cavities 16, which are made on either side of a mid-plane at said bottom 10 and, more preferably, for the or each receiving cavity 16, at the base of the corresponding longitudinal edge 11, so as to be able to recover the dust accumulated in the bottom 10 when the door is opened, i.e., without any protective guards 13 or 14 for the groove 9. The dust thus accumulated in the bottom 10 can then be pushed or swept into the receiving cavity or cavities 16, when the door is closed, by the movement of the gasket element 7 inserted into the groove 9 (FIG. 1).

Of course, the invention is not limited to the embodiments described and shown in the appended drawings. Modifications remain possible, in particular as concerns the composition of the various elements or by substituting technical equivalents, without thereby departing from the scope of protection of the invention.

What is claimed is:

1. A sill and opening-leaf assembly for a door that is fluid-tight and intended to seal an opening separating two spaces of a building, comprising:

an opening leaf having a lower edge face which is situated, when mounted, facing a floor surface, and a sill configured to prevent the passage of fluid through a bottom part of the door between the lower edge face and the floor surface, wherein the sill includes:

at least one flat and elongate gasket element, which includes a front longitudinal surface, a rear longitudinal surface, and a longitudinal attachment side, wherein the gasket element is attached via the longitudinal attachment side to the lower edge face of the opening leaf; and at least one groove including a bottom and two longitudinal edges, the groove made in the floor surface and extending across the opening, wherein the gasket element when mounted, is configured to engage with either of the two longitudinal edges of the groove and being allowed to travel into the groove depending on whether a pressure force is exerted by the fluid from one of the two spaces on the front longitudinal surface or rear longitudinal surface of the gasket element.

2. The assembly according to claim 1, wherein the gasket element is flexible, at least on the longitudinal attachment side thereof, so as to allow the gasket element a freedom of movement, by elastically deforming and bending around the longitudinal attachment side, in the groove, between the two longitudinal edges thereof.

3. The assembly according to claim 1, wherein the gasket element is selected from the group consisting of: a rigid gasket element, a semi-rigid gasket element, and a flexible gasket element, and is pivotably mounted via the longitudinal attachment side thereof, by a hinge pin joint, about a swivel pin extending along the lower edge face, so as to allow the gasket element a freedom of travel, by rotating about the swivel pin, inside the groove between the two longitudinal edges thereof.

4. The assembly according to claim 3, wherein the two longitudinal edges of the gasket element are inclined toward a bottom of the groove so that the internal surfaces thereof are each situated in a plan passing substantially through the longitudinal attachment side of the gasket element.

5. The assembly according to claim 3, wherein the two longitudinal edges of the gasket element are inclined toward the bottom of the groove so that the internal surfaces thereof are each situated in a plan passing substantially through the longitudinal attachment side of the gasket element and through the swivel pin.

6. The assembly according to claim 1, wherein the two longitudinal edges of the groove each form a right angle with the floor surface.

7. The assembly according to claim 6, wherein the groove defines a cross-sectional shape selected from the group consisting of: a U-shaped cross-section and a dovetail-shaped cross-section.

8. The assembly according to claim 7, wherein the configuration of the bottom of the groove is selected from the group consisting of: a flat and an arc of a circle.

9. The assembly according to claim 1, wherein the groove is made in an insert embedded into the floor surface.

10. The assembly according to claim 1, further comprising a protective dust-guard system extending longitudinally on either side of the gasket element, so as to prevent dust from either of the two spaces separated by the door opening, respectively, from reaching the groove.

11. The assembly according to claim 10, wherein the protective dust-guard system includes a dust-guard brush attached to the lower edge face where the gasket element is attached, the dust-guard brush comprising two dust-guard brush portions extending on either side of the gasket element as far as the corresponding floor surface, so that each forms a protective guard against the dust from one of the two spaces separated by the door opening.

12. The assembly according to claim 11, wherein the dust-guard brush is made from a material selected from the group consisting of: natural bristles, synthetic bristles and metal bristles, and wherein one end of the material is pressed into a support strip attached to or built into the lower edge face.

13. The assembly according to claim 10, wherein the protective dust-guard system includes two dust-guard brushes each attached to the lower edge face of the opening leaf, on either side of and separately from the gasket element, the two dust-guard brushes each extending as far as the corresponding floor surface, so that each forms a protective guard against the dust from one of the two spaces separated by the door opening.

14. The assembly according to claim 13, wherein each dust-guard brush is made from a material selected from the group consisting of: natural bristles, synthetic bristles and metal bristles, and wherein one end of the material is pressed into a support strip attached to or built into the lower edge face.

15. The assembly according to claim 10, wherein the bottom of the groove comprises at least one cavity for receiving dust, which is made on either side of a mid-plane at the bottom and, for the receiving cavity, at a base of the corresponding longitudinal edge.

16. The assembly according to claim 10, wherein the bottom of the groove comprises two receiving cavities for receiving dust, which are made on either side of a mid-plane at the bottom and, for each receiving cavity, at a base of the corresponding longitudinal edge.

17. The assembly according to claim 1, wherein the two longitudinal edges of the groove each form a right angle with the floor surface and are each are inclined toward the bottom of the groove so as to form a longitudinal abutment enabling the gasket element to be retained inside the groove when a pressure force is exerted by the fluid on either the front longitudinal surface or rear longitudinal surface.

* * * * *